US007469506B2

(12) United States Patent
Hosey

(10) Patent No.: US 7,469,506 B2
(45) Date of Patent: Dec. 30, 2008

(54) RETRACTABLE ROOF ASSEMBLY

(76) Inventor: Vincent J. Hosey, 4824 Carvel Ave., Indianapolis, IN (US) 46205

( * ) Notice: Subject to any disclaimer, the term of this patent is extended or adjusted under 35 U.S.C. 154(b) by 439 days.

(21) Appl. No.: 11/106,928

(22) Filed: Apr. 15, 2005

(65) Prior Publication Data

US 2005/0235579 A1 Oct. 27, 2005

Related U.S. Application Data

(60) Provisional application No. 60/565,467, filed on Apr. 26, 2004.

(51) Int. Cl.
*E04B 1/346* (2006.01)

(52) U.S. Cl. ..... 52/66; 52/72; 52/73

(58) Field of Classification Search ..... 52/3, 52/64–74; 4/498; 47/17; 472/92, 136
See application file for complete search history.

(56) References Cited

U.S. PATENT DOCUMENTS

| | | | | | |
|---|---|---|---|---|---|
| 2,687,814 | A | | 8/1954 | Romick | |
| 3,080,073 | A | | 3/1963 | Calandra | |
| 3,212,813 | A | * | 10/1965 | Peterson et al. | 296/176 |
| 4,075,795 | A | * | 2/1978 | Thomas | 52/8 |
| 4,190,013 | A | | 2/1980 | Otis et al. | |
| 4,979,869 | A | | 12/1990 | Mullin, Jr. | |
| 5,197,240 | A | | 3/1993 | Eryou | |
| 5,209,030 | A | * | 5/1993 | Sloditskie et al. | 52/79.5 |
| 5,394,659 | A | * | 3/1995 | Kawaguchi et al. | 52/66 |
| 5,461,832 | A | * | 10/1995 | Smith | 52/69 |
| 5,655,335 | A | * | 8/1997 | Vermeer | 52/66 |
| 6,007,288 | A | | 12/1999 | Maffett et al. | |
| 6,102,059 | A | * | 8/2000 | Miller | 135/87 |
| 6,149,225 | A | * | 11/2000 | Kellner | 296/173 |
| 6,223,479 | B1 | | 5/2001 | Stockli | |
| 6,253,498 | B1 | * | 7/2001 | Fanucci | 52/69 |
| 6,434,895 | B1 | * | 8/2002 | Hosterman et al. | 52/143 |
| 2003/0056446 | A1 | * | 3/2003 | Napier | 52/66 |

* cited by examiner

*Primary Examiner*—Richard E. Chilcot, Jr.
*Assistant Examiner*—Mark R Wendell
(74) *Attorney, Agent, or Firm*—Barnes & Thornburg LLP

(57) ABSTRACT

A retractable cover for a surface includes a first section configured to be movably coupled to the surface and covering at least a first portion of the surface. The first section is movable relative to the surface between an open orientation in which said first portion of the surface is uncovered and a closed orientation in which the first portion of the surface is covered. The retractable cover further includes a second section configured to be movably coupled to the surface. The second section is movable between a lowered orientation relatively closer to a second portion of the surface and a raised orientation relatively more remote from the second portion of the surface.

14 Claims, 7 Drawing Sheets

RETRACTABLE ROOF ASSEMBLY

CROSS-REFERENCE TO RELATED APPLICATION

This application claims priority under 35 U.S.C. 119(e) to U.S. Provisional Application Ser. No. 60/565,467, filed Apr. 26, 2004, which is expressly incorporated by reference herein.

BACKGROUND OF THE INVENTION

The present invention relates to building structure. It is disclosed in the context of a retractable roof for a boathouse or covered dock. However, it is believed to be useful in other applications as well.

Various types and configurations of watercraft storage systems are known. There are, for example, the storage systems described in the following U.S. Pat. Nos. 2,687,814; 3,080,073; 4,190,013; 4,979,869; 5,197,240; 6,007,288; 6,223,479. No representation is intended that a complete search has been made of all relevant prior art, or that no better art references than those listed are available, or that the listed references are material to patentability. Nor should any such representation be inferred.

SUMMARY OF THE INVENTION

According to an aspect of the invention, a retractable cover for a surface comprises a first section configured to be movably coupled to the surface and covering at least a first portion of the surface. The first section is movable relative to the surface between an open orientation in which said first portion of the surface is uncovered and a closed orientation in which the first portion of the surface is covered. The retractable cover further comprises a second section configured to be movably coupled to the surface and movable between a lowered orientation relatively closer to a second portion of the surface and a raised orientation relatively more remote from the second portion of the surface.

Further illustratively according to this aspect of the invention, the retractable cover includes a third section configured to be movably coupled to the surface and covering at least a third portion of the surface. The third section is movable relative to the surface between an open orientation in which said third portion of the surface is uncovered and a closed orientation in which the third portion of the surface is covered.

Illustratively according to this aspect of the invention, the first section and the third section are movable relative to the surface in generally opposite directions to their open orientations, and are movable relative to the surface in generally opposite directions to their closed orientations.

Additionally illustratively according to this aspect of the invention, the second section is oriented between the first and third sections.

According to another aspect of the invention, a retractable cover for a surface comprises a first section configured to be movably coupled to the surface and covering at least a first portion of the surface. The first section is movable relative to the surface between an open orientation in which said first portion of the surface is uncovered and a closed orientation in which the first portion of the surface is covered. A second section of the retractable cover is configured to be movably coupled to the surface and covering at least a second portion of the surface. The second section is movable relative to the surface between an open orientation in which the second portion of the surface is uncovered and a closed orientation in which the second portion of the surface is covered.

Further illustratively according to this aspect of the invention, the retractable cover includes a third section configured to be movably coupled to the surface. The third section is movable between a lowered orientation relatively closer to a third portion of the surface and a raised orientation relatively more remote from the third portion of the surface.

Illustratively according to this aspect of the invention, the first section and the second section are movable relative to the surface in generally opposite directions to their open orientations, and are movable relative to the surface in generally opposite directions to their closed orientations.

Additionally illustratively according to this aspect of the invention, the third section is oriented generally between the first and second sections.

Alternatively illustratively according to this aspect of the invention, the first and second sections move generally at non-zero angles to each other between their open orientations and their closed orientations.

Further or alternatively illustratively according to this aspect of the invention, the first and second sections move generally along a common line between their open orientations and their closed orientations.

Further illustratively according to this aspect of the present invention, the first and second sections move generally in opposite directions between their open orientations and their closed orientations.

According to yet another aspect of the invention, a retractable cover for use with a generally flat surface or rooftop comprises a frame configured to be coupled to the surface, side walls configured to be coupled to the surface generally around a perimeter of the surface, and a roof section coupled to the frame and the side walls. The roof section is movable relative to the frame, the side walls, and the surface between a closed position where the side walls and the roof section cooperate to define an enclosed area defined by the surface, the side walls, and the roof section and an opened position where a portion of the roof section is configured to extend substantially beyond the surface.

According to still another aspect of the invention, a retractable cover for use with a generally flat surface or rooftop comprises a first roof section configured to be coupled to the surface and movable relative to the surface between an opened position and a closed position and a second roof section configured to be coupled to the surface, spaced-apart from the first roof section, and movable relative to the surface between an opened position and a closed position. A canopy of the retractable cover is configured to be coupled to the surface and positioned between the first and second roof sections. The canopy is movable between a raised position and a lowered position. A first edge of the first roof section and a first edge of the second roof section are engaged with the canopy when the first and second roof sections are in the closed position and the canopy is in the opened position.

Further illustratively according to this aspect of the invention, roof cover further comprises a first retracting mechanism coupled to the first roof section to move the first roof section between the opened and closed positions, and a second retracting mechanism coupled to the second roof section to move the second roof section between the opened and closed positions.

Still further illustratively according to this aspect of the invention, the first and second roof sections each include a pitched truss configured to be coupled to the surface and a roof member coupled to the pitched truss for movement relative to the pitched truss between the opened and the closed positions.

According to another aspect of the invention, the first and second roof members are each arranged to move between the opened and closed positions along a direction parallel to a pitched beam member of each respective pitched truss.

According to still another aspect of the invention, each of the first and second retracting mechanisms include a motor coupled to the pitched truss of the respective first and second roof sections, a drive shaft, and a roller wheel coupled to the drive shaft for rotational movement with the drive shaft. The roller wheel is engaged with the respective pitched truss to move along a pitched beam of the respective pitched truss relative to the pitched truss.

According to yet another aspect of the invention, each of the first and second retracting mechanisms includes a motor coupled to the pitched truss of the respective first and second roof sections, a threaded drive shaft, and a travel nut coupled to the drive shaft and the pitched truss. Rotation of the threaded drive shaft by the motor causes the travel nut to translate on the threaded drive shaft to move the respective first and second roof sections between the opened and closed positions.

According to still another aspect of the invention, a truss assembly is pivotably coupled to the canopy and configured to be coupled to the surface. A pair of rollers is coupled to the truss assembly and to one of the first and second roof sections for movement with the one of the first and second roof sections. Movement of the pair of rollers with the one of the first and second roof sections urges the truss assembly to move between a generally angled position and a generally vertical position such that the canopy is in the raised position when the truss assembly is in the vertical position.

BRIEF DESCRIPTION OF THE DRAWINGS

The invention may best be understood by referring to the following detailed description and accompanying drawings which illustrate the invention. In the drawings.

DETAILED DESCRIPTION OF THE DRAWINGS

Figure 6:
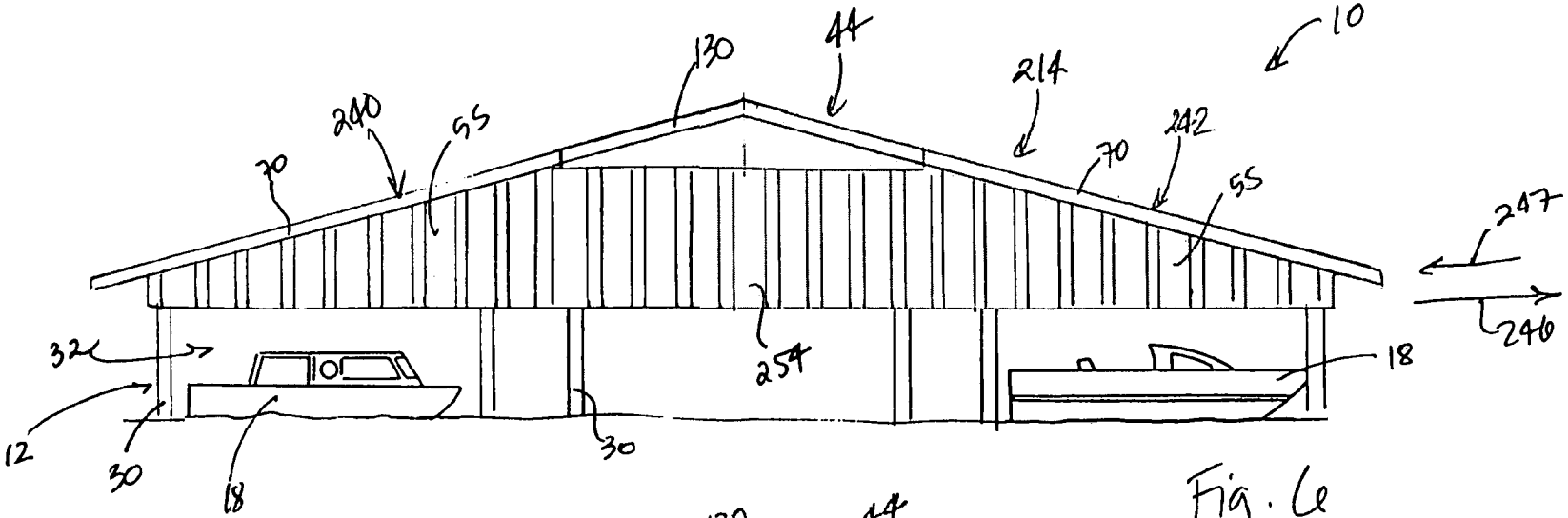
FIG. 6 illustrates an elevational view of the boathouse or covered dock illustrated in FIGS. 1-4, with the roof in the orientation illustrated in FIGS. 1 and 3, and with an optional detail.
Figure 7:
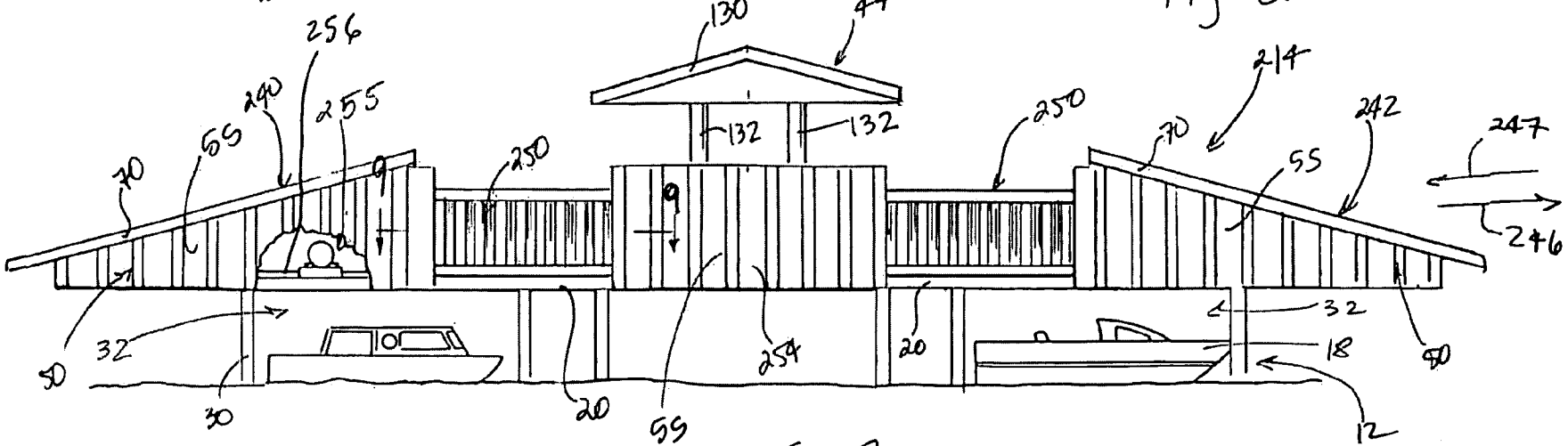
FIG. 7 illustrates an elevational view of the boathouse or covered dock illustrated in FIGS. 1-4 and 6, with the roof in the orientation illustrated in FIGS. 2 and 4, and incorporating the detail illustrated in FIG. 6.

A boathouse or covered dock 10 typically is constructed adjacent to, or with easy access from, a shore to provide easy access to watercraft 18 housed under the roof 14 of the boathouse 10. Boathouse 10 is provided to store or house watercraft 18 in a covered area to provide some protection for the stored watercraft 18. Boathouse 10 includes a boat storage facility 12 and a retractable roof assembly 14 movable between a closed orientation, illustrated in FIGS. 1, 3, and 6, and open orientations, for example, those illustrated in FIGS. 4 and 7. Retractable roof assembly 14 provides a platform 20 of boat storage facility 12 to be used as a sundeck and entertainment area 22 when retractable roof assembly 14 is in a retracted orientation, for example, as illustrated in FIGS. 2, 4 and 7. Retractable roof assembly 14 also provides storage for items on the entertainment area 22 when retractable roof assembly 14 is in the closed orientation and the entertainment area 22 is not in use, as illustrated in FIGS. 1, 3, and 6.

Retractable roof assembly 14 is illustratively provided on boat storage facility 12, retractable roof assembly 14 may also be provided on other structures such as, for example, office buildings, screened porches, hotel outdoor pool/bar areas, and the like.

Figure 1:
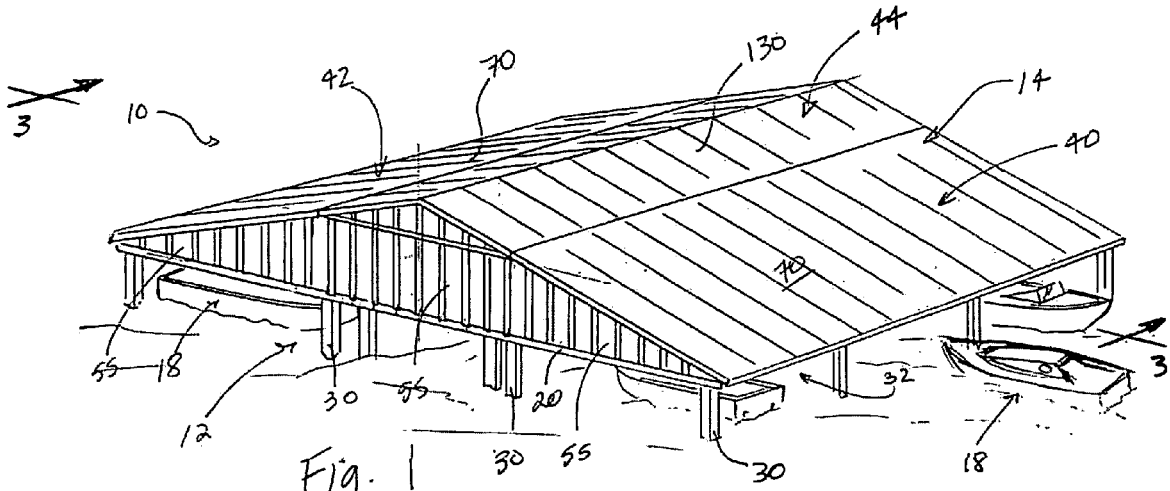
FIG. 1 illustrates a perspective view of a boathouse or covered dock incorporating a retractable roof, with the retractable roof illustrated in a first, closed orientation.
Figure 2:
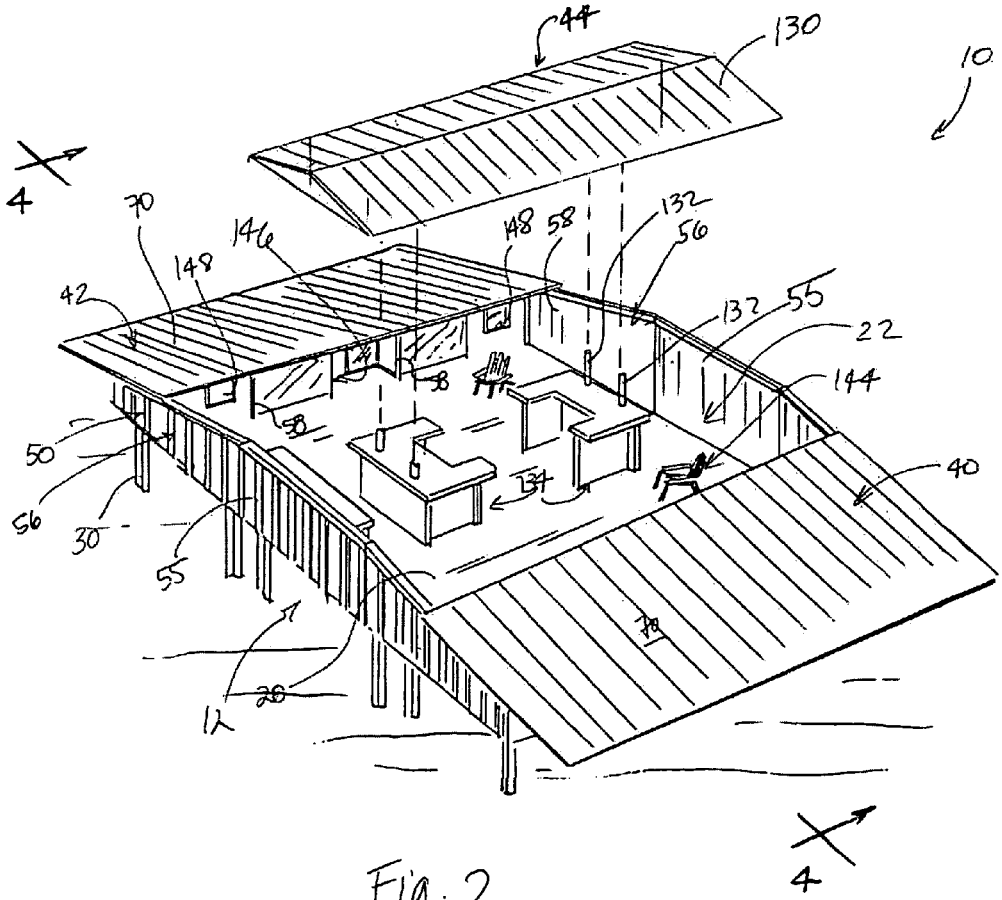
FIG. 2 illustrates a partly exploded perspective view of the boathouse or covered dock illustrated in FIG. 1, with the retractable roof in an opened position.
Figure 3:
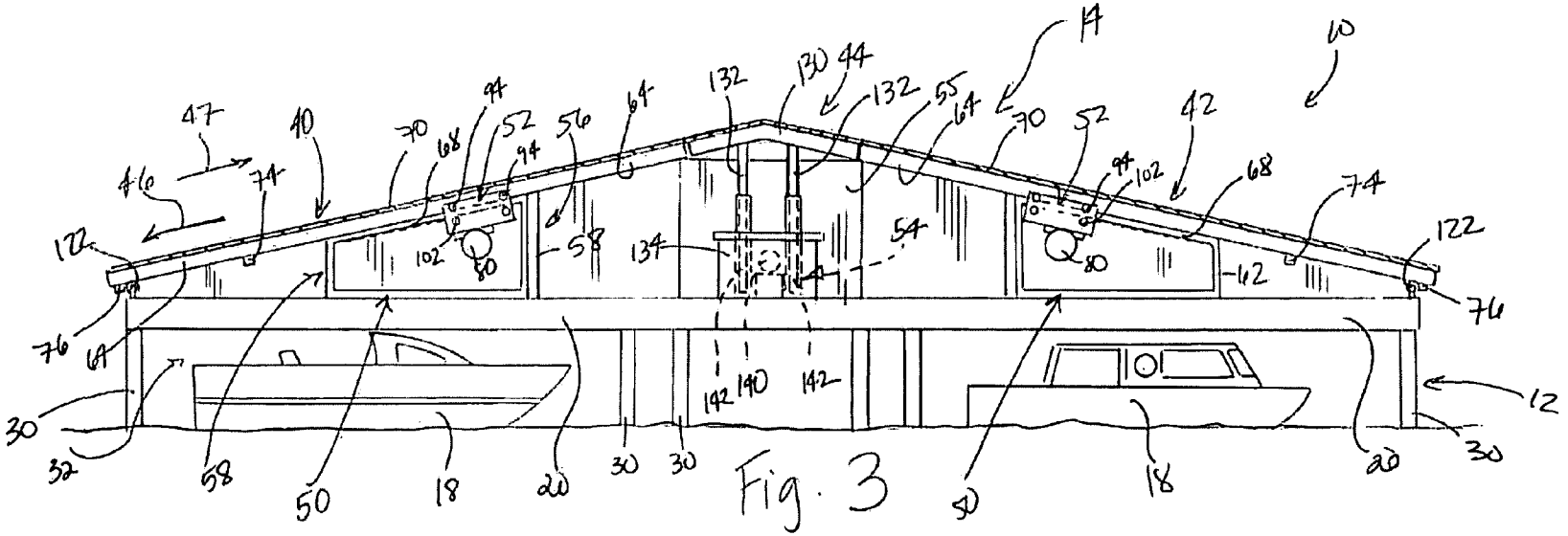
FIG. 3 illustrates a sectional view of the boathouse or covered dock illustrated in FIGS. 1-2, taken generally along section lines 3-3 of FIG. 1.
Figure 4:
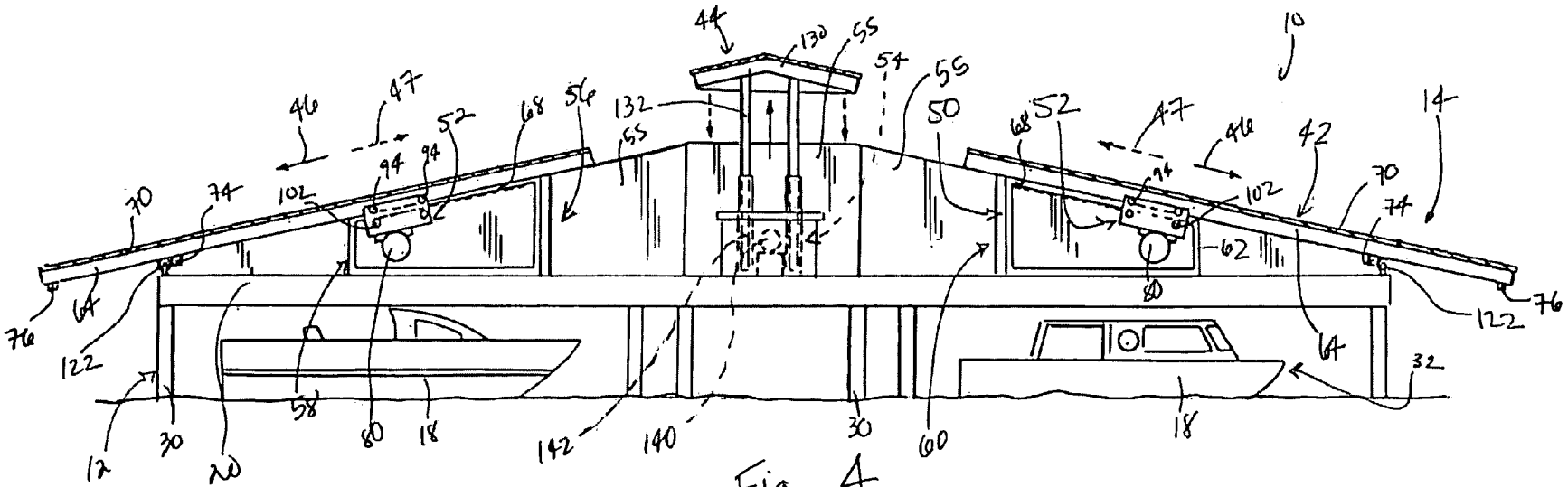
FIG. 4 illustrates a sectional view of the boathouse or covered dock illustrated in FIGS. 1-3, taken generally along section lines 4-4 of FIG. 2.

As illustrated in FIGS. 1-4, 6 and 7, boat storage facility 12 includes supports 30. Areas 32 are provided among the supports to dock watercraft 18, as illustrated in FIGS. 1, 3, and 4. Platform 20 is supported upon supports 30. Retractable roof assembly 14, when in the closed position, covers items on platform 20 and provides the items stored on platform 20 some protection from rain, wind, theft, etc. without the need to move the items to a separate storage area. Platform 20 thus becomes a storage area when the retractable roof assembly 14 is moved to the closed orientation. Retractable roof assembly 14 thus permits platform 20 to function as an entertainment area 22 and as a storage area.

Referring now particularly to FIGS. 2-4, retractable roof 14 includes a first and second sloping roof sections 40, 42, and a central canopy 44. Each sloping roof section 40, 42 is movable between a closed orientation, as illustrated in FIGS. 1 and 3, and an open orientation, as illustrated in FIGS. 2 and 4. As is discussed in greater detail below, the sloping roof sections 40, 42 slide at an angle in direction 46 along the pitch of frame 50 with the aid of respective retracting mechanisms 52 (illustrated in FIG. 5) as they move between open and closed orientations. The central canopy 44 also moves between a closed or lowered orientation, illustrated in FIG. 3, and an opened or raised orientation, illustrated in FIG. 4. The central canopy 44 moves up and down between open and closed orientations with the aid of a rack and pinion mechanism 54, illustrated in broken lines in FIGS. 3 and 4. Roof assembly 14 further includes gables 55. As illustrated in FIG. 2, the gables 55 are generally solid and cooperate with the sloping roof sections 40, 42 and canopy 44 to define an enclosed area which offers some protection from theft and inclement weather to items on platform 20.

Frame 50 of retractable roof assembly 14 includes a first frame section 56 including multiple truss members 58 coupled to platform 20. First sloping roof section 40 is coupled to first frame section 56 and is movable back and forth along first frame section 56 in direction 46 as illustrated in FIG. 4. Frame 50 further includes a second frame section 60 including multiple truss members 62 coupled to platform 20. Second sloping roof section 42 is coupled to second frame section 60 and is movable back and forth along second frame section 60 in direction 46 as well. As is discussed in greater detail below, bar joists 64 (illustrated in FIG. 5) of each respective sloping roof section 40, 42 are coupled to respective truss members 58, 62 through a respective retracting mechanism 52 for movement by retracting mechanism 52 along a pitched beam 68 of each truss member 58, 62.

Each sloping roof section 40, 42 includes several bar joists 64 and a decking portion 70 coupled to the bar joists 64. Shingles or other roofing material typically will be provided on decking portion 70. Stops 74, 76 are provided on each of the first and second sloping roof sections 40, 42 to limit the opening and closing movement of each roof section 40, 42.

Roof assembly 14 includes one or more retracting mechanisms 52 coupled to first roof section 40 and one or more retracting mechanism 52 coupled to second roof section 42. Roof assembly 14 further includes central canopy 44 with rack-and-pinion mechanism 54. In the illustrated embodiment, the retracting mechanisms 52 are identical. Therefore, only one retracting mechanism 52, illustrated in FIG. 5, will be described in detail. Retracting mechanism 52 illustratively is coupled to two truss members 58. Retracting mechanism 52 includes a drive motor assembly 80 including a drive motor 82, a drive belt 84 coupled to a rotational output shaft 86 of drive motor 82, and a gear box 88 coupled to drive belt 84. Specifically, retracting mechanism 52 is coupled to pitched beam 68 of each truss member 58. Although only one retracting mechanism 52 is coupled to each roof section 40, 42, roof assembly 14 may include multiple retracting mechanisms 52 on each roof section 40, 42 to move each roof section 40, 42 between the opened and closed orientations.

Figure 5:
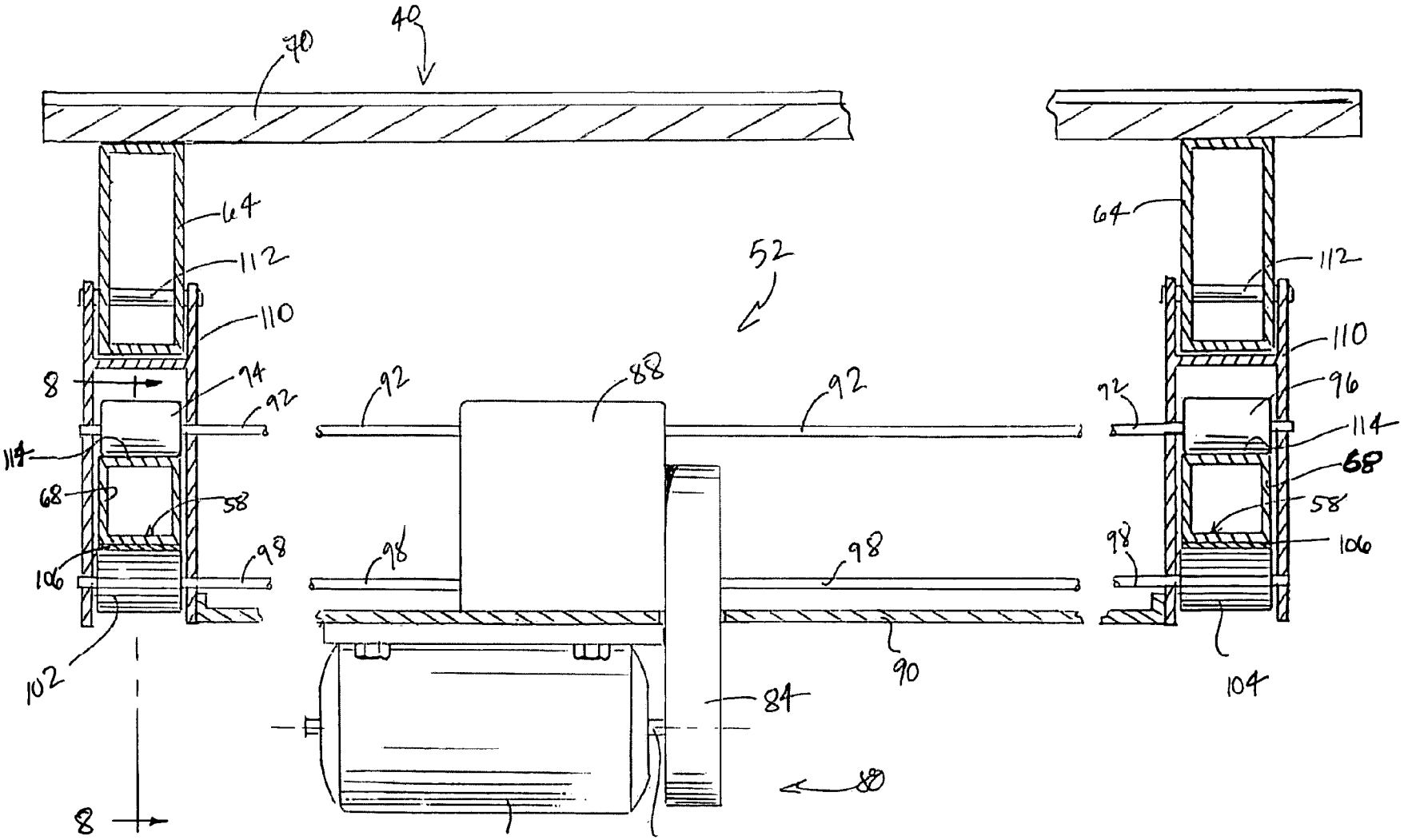
FIG. 5 illustrates a fragmentary, schematic, partly sectional side elevational view of a retracting mechanism for the roof of the boathouse or covered dock illustrated in FIGS. 1-4.
Figure 8:
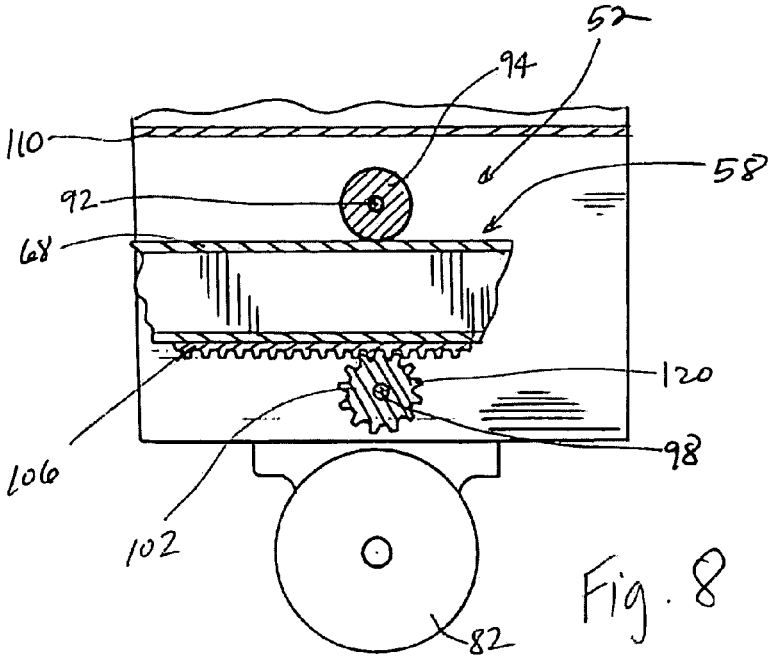
FIG. 8 illustrates a fragmentary sectional view of the retracting mechanism illustrated in FIG. 5, taken generally along section lines 8-8 of FIG. 5.

As illustrated in FIG. 5, drive motor assembly 80 is positioned between the two truss members 58 and is supported upon a cross-beam 90. Cross-beam 90 is coupled to and extends between the two truss members 58. A first drive shaft 92 is coupled to motor assembly 80 and extends between the two truss members 58. A first roller 94 is coupled to a first end of drive shaft 92 while a second roller 96 is coupled to a second end of drive shaft 92. A second drive shaft 98 of retracting mechanism 52 is coupled to motor assembly 80 and also extends between the two truss members 58. Illustratively, the second drive shaft 98 is positioned below the first drive shaft 92. A first pinion gear 102 is coupled to a first end of second drive shaft 98 and a second pinion gear 104 is coupled to a second end of the second drive shaft 98. As best illustrated in FIG. 8, each pinion gear 102, 104 engages a respective rack 106 provided on the underside of a respective pitched beam 68 of a respective truss member 58. As is discussed in greater detail below, actuation of motor 80 rotates pinion gears 102, 104 in engagement with respective racks 106, causing roof section 40 to move back and forth in directions 46, 47 along stationary truss member 58.

Each bar joist 64 is coupled to a bracket 110, for example, by a bolt 112. As illustrated in FIGS. 4, 5, and 8, each of the first and second rollers 94, 96 are positioned above and engage a top surface 114 of a pitched beam 68 of each truss member 58. Further, as mentioned above, a rack 106 is provided on a bottom surface of pitched beam 68 in engagement with a respective one of the gears 102, 104. Apertures are provided in bracket 110 to permit passage of the first and second drive shafts 92, 98. Brackets 110 couple retracting mechanism 52 to truss members 58 and to bar joists 64 of roof sections 40, 42.

In operation, motor 82 works through transmission 88 to cause drive shafts 92, 98 to selectively rotate in either a retracting (or opening) direction or a closing direction. Each roller 94, 96 and pinion 102, 104 coupled to a respective drive shaft 92, 98 is driven to rotate in the same direction as its respective drive shaft 92, 98. As the rollers 94, 96 and pinions 102, 104 are rotated, teeth 120 of each pinion 102, 104 engage a rack 106 coupled to a respective pitched beam member 68 to move retracting mechanism 52 with bar joists 64 toward either the open or closed positions. Thus, the retracting mechanisms 52 are coupled to roof sections 40, 42 to move back and forth in directions 46, 47 along pitched beam 68 of truss members 58 of frame 50. Illustratively, and as best illustrated in FIG. 4, pitched beams 68 of truss members 58 are angled or pitched. Therefore, side portions 40, 42 move along the pitches of beams 68 as they move back and forth between the closed and open orientations. Frame 50, with truss members 58, remains stationary on platform 20.

As illustrated in FIGS. 3 and 4, an end roller 122 is mounted adjacent each side edge of platform 20. Each end roller 122 supports one or more bar joists 64 of a respective side portion 40, 42 as each is moved between the opened and closed orientations. Further, each end roller 122 is urged to roll as the first and second portions 40, 42 are moved back and forth between the opened and closed positions to provide for a generally smooth and continuous motion. Although a particular type of retracting mechanism 52 is described, it is within the scope of this disclosure to include any other suitable retracting mechanisms for moving side portions 40, 42 of roof assembly 14 between opened and closed orientations.

Stops 74, 76 on bar joists 64 prevent the respective side portions 40, 42 from being moved too far in either direction. For example, first stops 74 engage respective end rollers 122 when their respective roof sections 40, 42 have moved in direction 46 to fully open orientations. Stops 74 prevent side portions or roof sections 40, 42 from moving beyond that point. When stops 74 engage end rollers 122 the resistance encountered by the motor 80 may cause the motor 80 to shut off automatically, or limit switches or other means (not shown) may be provided to stop the motor 80. Stops 76 engage end rollers 122 when side portions 40, 42 have moved in direction 47 to the closed orientation as illustrated in FIG. 3. Stops 76 prevent side portions 40, 42 from moving beyond that point. Again, the increased resistance against motor 80 caused by second stops 76 engaging end rollers 122, limit switches or other means may automatically shut the motor 80 off.

As mentioned above, roof assembly 14 further includes central canopy 44 which moves between a closed or lowered position, illustrated in FIG. 3, and an opened or raised position, illustrated in FIG. 4. Illustratively, canopy 44 includes a roof portion 130 and four supports 132 coupled to roof portion 130. As illustrated in FIG. 2, supports 132 project in pairs into and from wells provided for supports 132 in two bar countertops 134. As illustrated in FIGS. 3 and 4, rack and pinion mechanisms 54 are provided to raise and lower canopy 44 as desired. Each rack and pinion mechanism 54 cooperates with one set of supports 132 and is housed beneath one of the respective bar countertops 134. Each rack and pinion mechanism 54 includes a motor 140 (illustrated in broken lines) and pinion gears (not shown) coupled to the motor 140. The pinion gears engage the teeth of each rack 142 to raise or lower the respective rack 142, depending on which direction the motor 140 is rotating. Of course, jackscrews, pneumatic jacks, hydraulic jacks, or other suitable means may be used instead of the rack and pinion jacking mechanisms to lift and lower the canopy 44. The wells for supports 132 can also be mounted directly upon platform 20.

It is contemplated that a single switch control the operation of both of the side portions 40, 42 and canopy 44 such that an operator may actuate the switch to "open" to cause each component of the roof assembly 14 to move to the open orientation, illustrated in FIG. 4, and may actuate the switch to "close" to cause each component of the roof assembly 14 to move to the closed orientation, illustrated in FIG. 3. However, it is also contemplated that each of the side portions 40, 42 and the central canopy 44 may be operated independently from one another.

As discussed above, platform 20 may be used as a sundeck and/or entertainment area 22. As illustrated in FIG. 2, bar tables 134 are provided and may house bar goods such as glasses, foods, beverages, and so on. Other tables and chairs, such as chairs 144, may be provided as well. Further, truss members 58 may be spaced so that areas 146 are provided between adjacent truss members 58 for additional storage. Illustratively, areas 146 remain covered by roof assembly 14 when roof assembly 14 is in the open position. Areas 146 permit, for example, televisions 148 to be placed between truss members 58, for example, as illustrated in FIG. 2. As mentioned above, the items on platform 20, such as the bar tables 134, the chairs 144, televisions 148, and so on, are protected to some extent within roof assembly 14 when roof assembly 14 is in the closed position and, therefore, these items may not need to be moved to a separate storage area. Roof assembly 14 provides the convenience of having a sundeck or entertainment area 22 and may reduce or eliminate the need to provide separate storage for the items on the sundeck or entertainment area 22. Roof assembly 14 may also provide the boathouse owner and persons who dock or store their watercraft 18 in the boathouse 10 to stow items within the entertainment area 22 when the entertainment area 22 is not in use.

Referring now to FIGS. 6 and 7, another form of retractable roof assembly 214 is illustrated. In this embodiment, roof assembly 214 is coupled to platform 20 of boat storage facility 12 described above. Retractable roof assembly 214 is movable between a closed position, as illustrated in FIG. 6, and an open position, as illustrated in FIG. 7. Roof assembly 214 includes side portions or sloping roof sections 240, 242 and canopy 44. As illustrated in FIG. 7, side portions 240, 242 and frame 250 move back and forth in directions 246, 247 parallel to platform 20. Illustratively, a motor and rack and pinion system 255 is coupled to the frame 250 of each side portion 240, 242 as well as to platform 20 in order to move each side portion 240, 242 and frame 50 back and forth along (a) track(s) 256 provided on platform 20 between the open FIG. 7 position and the closed FIG. 6 position. As illustrated in FIG. 7, for example, the overhang from each side portion 240, 242 creates additional covered boat docking area 32 when roof assembly 214 is in the open position.

Figure 9:
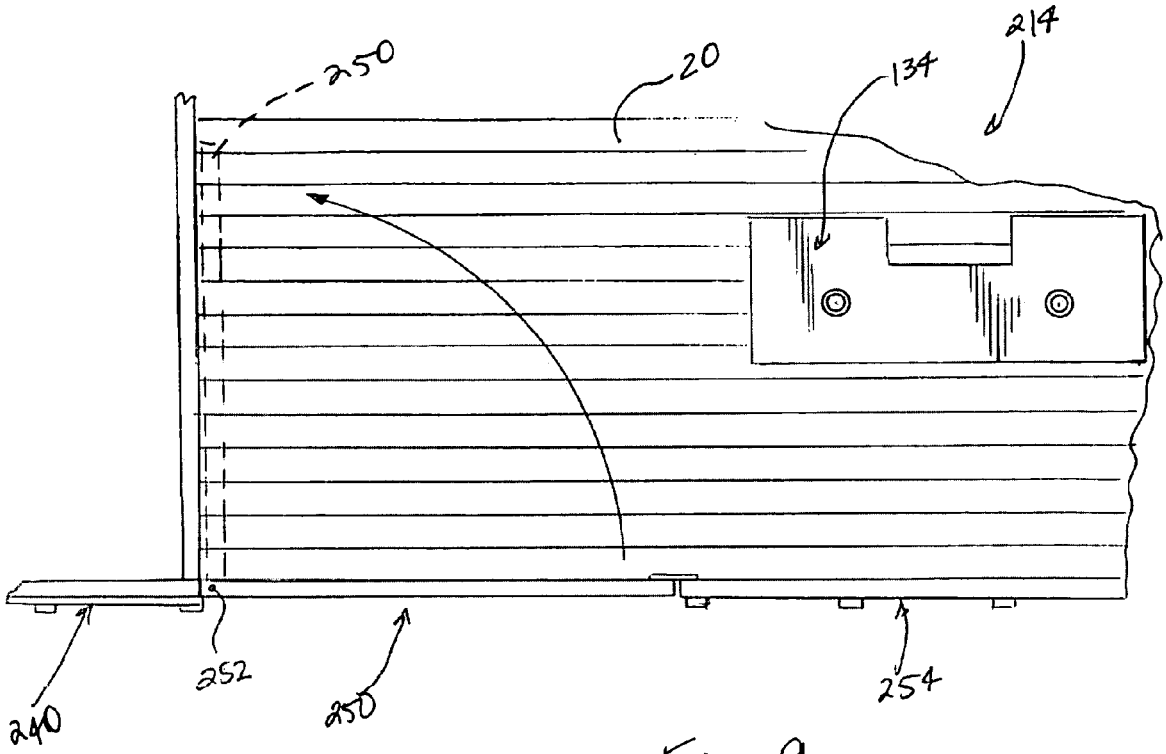
FIG. 9 illustrates a fragmentary top plan view, taken generally along section lines 9-9 of FIG. 7 illustrating a detail of FIGS. 6-7.

A pivotable gate 250 of roof assembly 214 is illustrated in FIGS. 7 and 9. As illustrated in FIG. 9, gate 250 pivots about a point 252 between an open position (illustrated in broken lines in FIG. 9) and a closed position coupled to a central gable end member 254 of roof assembly 214. Gate 250 provides a barrier about platform 20 when roof assembly 214 is in the open position. Prior to moving roof assembly 214 to the closed position, an operator unlatches each gate 250 from the central frame member 254 and swings each gate 250 to the stowed position to permit side portions 240, 242 to move in direction 247 toward central frame member 254.

Figure 10:
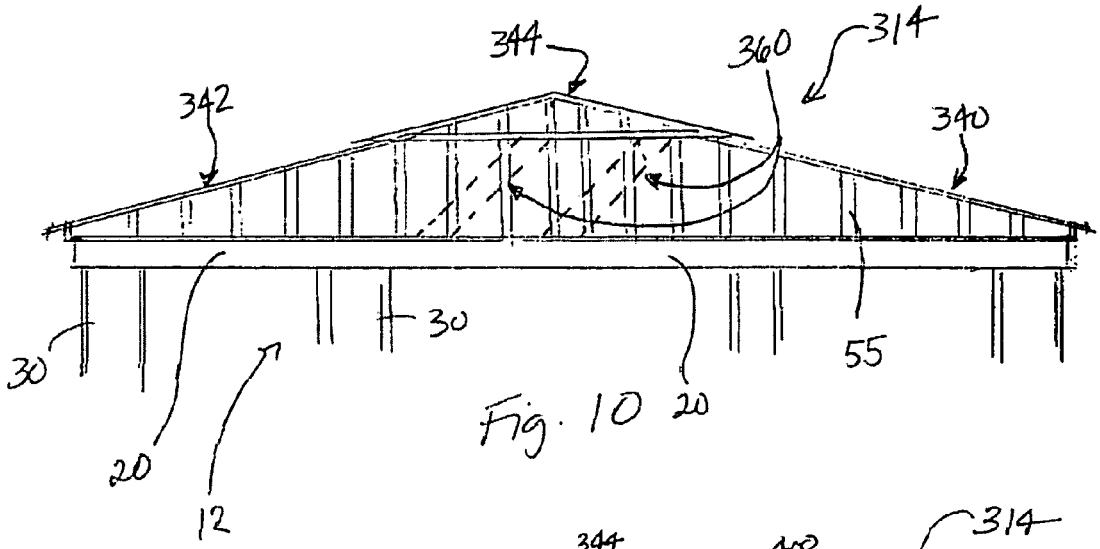
FIG. 10 illustrates a front view of an alternative boathouse or covered dock incorporating a retractable roof, with the retractable roof illustrated in a first, closed orientation.
Figure 11:
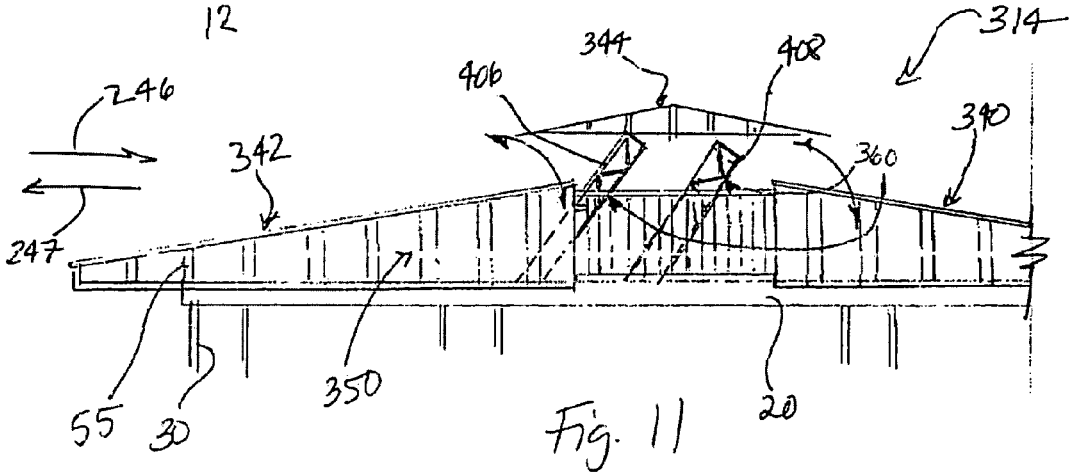
FIG. 11 illustrates a front view of the covered dock of FIG. 10 showing the retractable roof moving toward a second, opened orientation.
Figure 12:
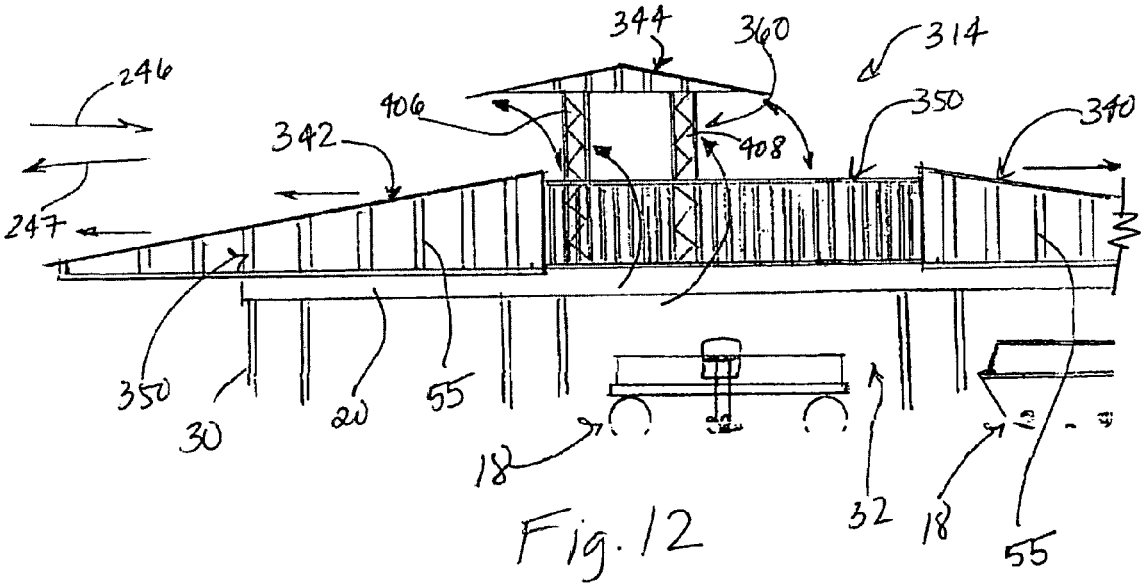
FIG. 12 illustrates a front view of the covered dock of FIGS. 10 and 11 showing the retractable roof in the second, opened orientation.
Figure 13:
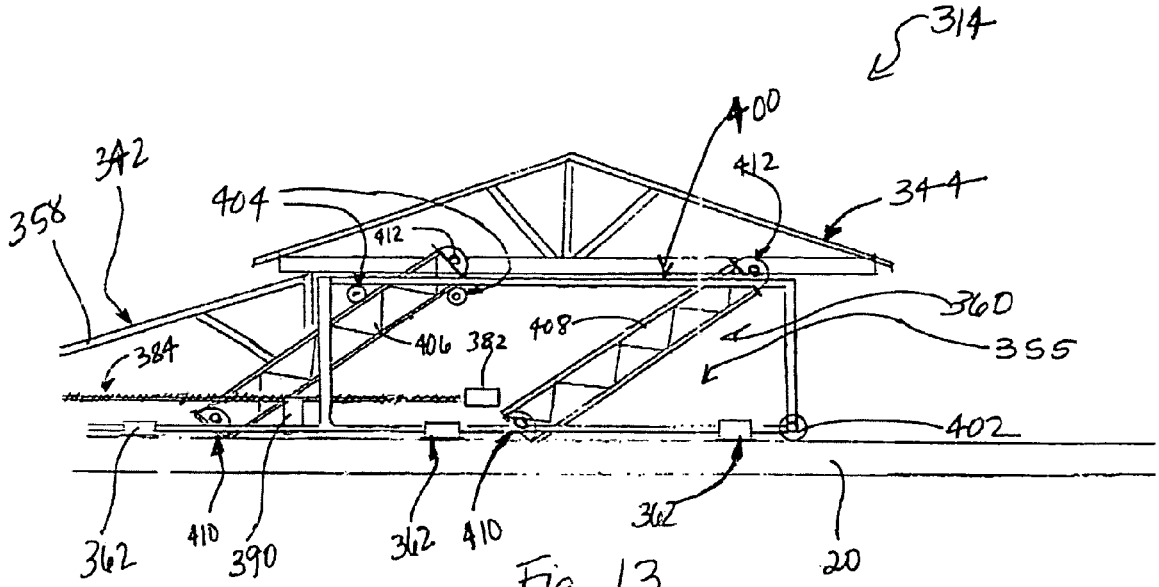
FIG. 13 illustrates a fragmentary sectional view of the roof portion of the retractable roof of FIGS. 10-12 showing a lifting mechanism of the roof portion including two parallel truss portions.
Figure 14:
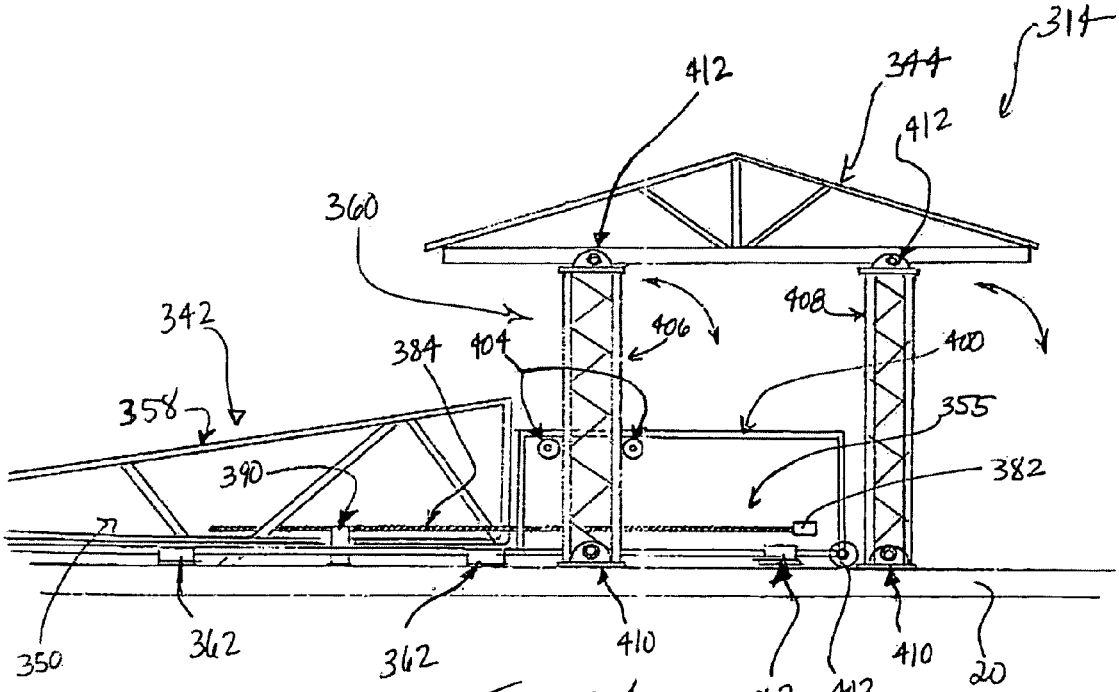
FIG. 14 illustrates a fragmentary sectional view of the roof portion of the retractable roof of FIGS. 10-13 showing the roof in the open orientation.

Referring now to FIGS. 10-14, another form of a retractable roof assembly 314 is illustrated. In this embodiment, roof assembly 314 is coupled to platform 20 of boat storage facility 12 described above. Retractable roof assembly 314 is movable between a closed position, as illustrated in FIG. 10, and an open position, as illustrated in FIG. 12. Roof assembly 314 includes side portions or sloping roof sections 340, 342 and a canopy 344. As illustrated in FIGS. 12-14, side portions 340, 342 and frame 350 move back and forth in directions 246, 247 parallel to platform 20. The central canopy 344 also moves between a closed or lowered orientation, illustrated in FIGS. 10 and 13, and an opened or raised orientation, illustrated in FIGS. 12 and 14. The central canopy 344 moves up and down between the opened and closed orientations with the aid of a truss assembly 360 illustrated in FIGS. 13 and 14. As illustrated in FIG. 12, the central canopy 344 is positioned generally off-center of the roof assembly 314 when in the raised position.

Looking to FIGS. 13 and 14, a first screw drive mechanism 355 is coupled to the frame 350 of the illustrative side portion 342 as well as to platform 20 in order to move the side portion 342 and frame 350 back and forth along (a) track(s) 362 provided on platform 20 between the opened position and the closed position. Illustratively, the mechanism 355 also operates with the truss assembly 360 to move the canopy 344 between the lowered and raised positions. A second screw drive mechanism (not shown) may be provided in order to move the other side portion 340 back and forth between the opened position and the closed position.

As illustrated in FIGS. 13 and 14, mechanism 355 includes a drive motor 382 mounted to platform 20 by, for example, a bracket (not shown). Motor 382 is coupled to a threaded drive shaft 384 to rotate the threaded drive shaft 384. A travel nut 390 of mechanism 355 threadedly receives the threaded drive shaft 384 coupling it to a truss member 358 of frame 350 of the side portion 342. As such, rotation of the drive shaft 384 in a first direction causes the travel nut 390 to move along the drive shaft 384 in a first direction away from the motor 382 and thereby causes the truss member 358 to move to the opened position illustrated in FIGS. 2 and 14. Rotation of the drive shaft 384 in a second and opposite direction causes the travel nut 390 to move along the drive shaft 384 in a second direction toward the motor 382. The truss member moves with the nut 390 to the closed position illustrated in FIGS. 11 and 13.

Illustratively, movement of the truss member 358 toward the open position causes the canopy 344 to move to the raised position. As illustrated in FIGS. 13 and 14, for example, a frame section 400 is coupled to truss member 358 and includes a roller 402 to permit the frame section 400 to move with the truss member 358 along the track 362. A pair of rollers 404 are coupled to an upper frame member of the frame section 400. Illustratively, a first truss member 406 of the truss assembly 360 is positioned between the pair of rollers 404, as illustrated in FIGS. 13 and 14. Each of the first truss member 406 and a second, parallel truss member 408 of the truss assembly 360 includes a lower pivot brackets 410 mounted on the platform 20 and upper pivot brackets 412 on which the canopy 344 is mounted. One or both of rollers 404 is (are) biased by (a) spring(s) or the like (not shown) to promote continuous contact with truss member 406.

In operation, rotation of the motor 382 in the first direction causes the truss member 358 and the frame section 400 to move toward the opened position or to the left as illustrated in FIGS. 13 and 14. Movement of the pair of rollers 404 to the left with the frame section 400 causes the first and second truss members 406, 408 to pivot in their respective stationary pivot brackets 410 toward generally vertical orientations. As the truss members 406, 408 move toward vertical orientations, the canopy 344 is raised to the position illustrated in FIG. 14. As the motor 382 is rotated in the second direction, the frame section 400 and pair of rollers 404 are moved to the right and thereby urge the first and second truss members 406, 408 to pivot in their respective stationary pivot brackets 410 to move toward the orientations illustrated in FIGS. 10 and 13. As the truss members 406, 408 move to the angled orientations illustrated in FIGS. 10 and 13, the canopy 344 moves to the lowered position. Illustratively, the arrangement of the truss assembly 360 causes the canopy 344 to be positioned in a generally off-center location when in the raised orientation, as illustrated in FIG. 12.

Many of the components of roof assemblies 14, 114, 314 described herein may be made of aluminum and/or filled or unfilled resins to resist weathering and deterioration. Plastic, vinyl, or canvas covers (not shown) may be provided to cover storage areas 146, for example.

What is claimed is:

1. A retractable cover for a surface comprising:

a first section configured to be movably coupled to the surface and covering at least a first portion of the surface, the first section being movable relative to the surface between an open orientation in which said first portion of the surface is uncovered and a closed orientation in which the first portion of the surface is covered, a second section configured to be movably coupled to the surface and covering at least a second portion of the surface, the second section being movable relative to the surface between an open orientation in which the second portion of the surface is uncovered and a closed orientation in which the second portion of the surface is covered, wherein the first and second sections are configured to move in a linear direction relative to the surface, and a third section configured to be movably coupled to the surface and movable between a lowered orientation relatively closer to a third portion of the surface and a raised orientation relatively more remote from the third portion of the surface.

2. The retractable cover of claim 1 wherein the first section and the second section are movable relative to the surface in generally opposite directions to their open orientations, and are movable relative to the surface in generally opposite directions to their closed orientations.

3. The retractable cover of claim 1 in which the third section is oriented generally between the first and second sections.

4. The retractable cover of claim 1 wherein the first and second sections move generally at non-zero angles to each other between their open orientations and their closed orientations.

5. The retractable cover of claim 1 wherein the first and second sections move generally along a common line relative to one another between their open orientations and their closed orientations.

6. The retractable cover of claim 1 wherein the first and second sections move generally in opposite directions relative to one another between their open orientations and their closed orientations.

7. A retractable cover for use with a generally flat surface or rooftop comprising:

a first roof section configured to be coupled to the surface and movable relative to the surface between an opened position and a closed position, a second roof section configured to be coupled to the surface, spaced-apart from the first roof section, and movable relative to the surface between an opened position and a closed position, a canopy configured to be coupled to the surface and positioned between the first and second roof sections, the canopy being movable between a raised position and a lowered position, wherein a first edge of the first roof section and a first edge of the second roof section are engaged with the canopy when the first and second roof sections are in the closed position and the canopy is in the closed position and are disengaged from the canopy when the canopy is in the opened position.

8. The retractable cover of claim 7, further comprising a first retracting mechanism coupled to the first roof section to move the first roof section between the opened and closed positions, and a second retracting mechanism coupled to the second roof section to move the second roof section between the opened and closed positions.

9. The retractable cover of claim 8, wherein the first and second roof sections each include a pitched truss configured to be coupled to the surface and a roof member coupled to the pitched truss for movement relative to the pitched truss between the opened and the closed positions.

10. The retractable cover of claim 9, wherein the first and second roof members are each arranged to move between the opened and closed positions along a direction parallel to a pitched beam member of each respective pitched truss.

11. The retractable cover of claim 8, wherein each of the first and second retracting mechanisms includes a motor coupled to the pitched truss of the respective first and second roof sections, a drive shaft, and a roller wheel coupled to the drive shaft for rotational movement with the drive shaft, and wherein the roller wheel is engaged wit the respective pitched truss to move along a pitched beam of the respective pitched truss relative to the pitched truss.

12. The retractable cover of claim 8, wherein each of the first and second retracting mechanisms includes a motor coupled to a pitched truss of the respective first and second roof sections, a threaded drive shaft, and a travel nut coupled to the drive shaft and the pitched truss, wherein rotation of the threaded drive shaft by the motor causes the travel nut to translate on the treaded drive shaft to move the respective first and second roof sections between the opened and closed positions.

13. The retractable roof cover of claim 12, further including a truss assembly configured to be pivotably coupled to the canopy and the surface, and rollers for engaging the truss assembly, the rollers coupled to one of the first and second roof sections for movement with the one of the first and second roof sections, movement of the rollers with the one of the first and second roof sections urging the truss assembly to move between a generally angled orientation in which the canopy is in the lowered position and a generally vertical orientation in which the canopy is in the raised position.

14. The retractable roof cover of claim 7, further including a truss assembly pivotably coupled to the canopy and coupled to one of the first and second roof sections such that movement of the one of the first and second roof sections to the opened position causes the canopy to move to the raised position.

* * * * *